US009719217B2

(12) United States Patent
Fritz et al.

(10) Patent No.: US 9,719,217 B2
(45) Date of Patent: Aug. 1, 2017

(54) SELF-PROPELLED CONSTRUCTION MACHINE AND METHOD FOR VISUALIZING THE WORKING ENVIRONMENT OF A CONSTRUCTION MACHINE MOVING ON A TERRAIN

(71) Applicant: Wirtgen GmbH, Windhagen (DE)

(72) Inventors: Matthias Fritz, Linz (DE); Cyrus Barimani, Konigswinter (DE)

(73) Assignee: Wirtgen GmbH (DE)

( * ) Notice: Subject to any disclaimer, the term of this patent is extended or adjusted under 35 U.S.C. 154(b) by 15 days.

(21) Appl. No.: 14/834,541

(22) Filed: Aug. 25, 2015

(65) Prior Publication Data

US 2016/0060825 A1 Mar. 3, 2016

(30) Foreign Application Priority Data

Aug. 28, 2014 (DE) ..... 10 2014 012 836

(51) Int. Cl.
*E01C 23/01* (2006.01)
*E01C 19/48* (2006.01)

(52) U.S. Cl.
CPC ..... *E01C 23/01* (2013.01); *E01C 19/4886* (2013.01)

(58) Field of Classification Search
None
See application file for complete search history.

(56) References Cited

U.S. PATENT DOCUMENTS 5,288,167 A 2/1994 Gaffard et al.
5,519,620 A 5/1996 Talbot et al.
(Continued)

FOREIGN PATENT DOCUMENTS

DE 19750315 A1 5/1998
DE 29918747 U1 2/2000
(Continued)

*Primary Examiner* — Rami Khatib
(74) *Attorney, Agent, or Firm* — Lucian Wayne Beavers; Patterson Intellectual Property Law, PC

(57) ABSTRACT

The invention relates to a self-propelled construction machine, in particular a road milling machine or a slipform paver, which can carry out translational and/or rotational movements for a planned project on a terrain. In addition, the invention relates to a method for visualizing the working environment of a construction machine moving on the terrain, in particular a road milling machine or a slipform paver. The construction machine comprises an image recording unit for recording an image segment of the terrain located in a coordinate system (X, Y, Z) dependent on the position and orientation of the construction machine on the terrain, and a display unit for displaying the image segment of the terrain. Moreover, the construction machine comprises a data processing unit which is configured in such a way that a depiction of a part of the project located in the image segment is superimposed on the image segment of the terrain displayed on the display unit, such that the project is visualized in the image segment. The display unit thus displays not only the actual image segment, but also a virtual image of the project, thus widening the perception of the machine operator. As a result, the machine operator can identify on the display unit whether the project forming the basis of the control matches the reality.

18 Claims, 8 Drawing Sheets

(56) References Cited

U.S. PATENT DOCUMENTS

| | | | | |
|---|---|---|---|---|
| 5,549,412 | A | 8/1996 | Malone | |
| 5,612,864 | A | 3/1997 | Henderson | |
| 5,631,658 | A | 5/1997 | Gudat et al. | |
| 5,781,437 | A * | 7/1998 | Wiemer | G01C 21/3688 340/995.26 |
| 5,838,277 | A | 11/1998 | Loomis et al. | |
| 5,929,807 | A | 7/1999 | Viney et al. | |
| 6,027,282 | A | 2/2000 | Horn | |
| 6,047,227 | A | 4/2000 | Henderson et al. | |
| 6,074,693 | A | 6/2000 | Manning | |
| 6,088,644 | A | 7/2000 | Brandt et al. | |
| 6,113,309 | A | 9/2000 | Hollon et al. | |
| 6,140,957 | A | 10/2000 | Wilson et al. | |
| 6,144,318 | A | 11/2000 | Hayashi et al. | |
| 6,152,648 | A | 11/2000 | Gfroerer et al. | |
| 6,191,732 | B1 | 2/2001 | Carlson et al. | |
| 6,287,048 | B1 | 9/2001 | Hollon et al. | |
| 6,371,566 | B1 | 4/2002 | Haehn | |
| 6,425,186 | B1 | 7/2002 | Oliver | |
| 6,481,924 | B1 | 11/2002 | Smolders et al. | |
| 6,655,465 | B2 | 12/2003 | Carlson | |
| 6,736,216 | B2 | 5/2004 | Savard | |
| 6,769,836 | B2 | 8/2004 | Lloyd | |
| 6,916,070 | B2 | 7/2005 | Sehr | |
| 6,950,059 | B2 | 9/2005 | Rapoport | |
| 7,002,513 | B2 | 2/2006 | Brabec | |
| 7,029,199 | B2 | 4/2006 | Mayfield et al. | |
| 7,363,154 | B2 | 4/2008 | Lindores | |
| 7,399,139 | B2 | 7/2008 | Kieranen | |
| 7,443,167 | B2 | 10/2008 | Siegel et al. | |
| 7,491,014 | B2 | 2/2009 | Sick | |
| 7,510,347 | B2 | 3/2009 | Lemke | |
| 7,530,641 | B2 | 5/2009 | Berning et al. | |
| 7,617,061 | B2 | 11/2009 | Brabec | |
| 7,643,923 | B2 | 1/2010 | Buehlmann et al. | |
| 7,856,302 | B2 | 12/2010 | Rasmussen | |
| 7,946,787 | B2 | 5/2011 | Glee et al. | |
| 7,946,788 | B2 | 5/2011 | Jurasz et al. | |
| 8,018,376 | B2 | 9/2011 | McClure | |
| 8,174,437 | B2 | 5/2012 | Whitehead | |
| 8,246,270 | B2 | 8/2012 | Berning et al. | |
| 8,271,194 | B2 | 9/2012 | Whitehead | |
| 8,388,263 | B2 | 3/2013 | Fritz et al. | |
| 8,613,566 | B2 | 12/2013 | Fritz et al. | |
| 8,977,442 | B2 | 3/2015 | Menzenbach et al. | |
| 8,989,968 | B2 | 3/2015 | Fritz et al. | |
| 9,096,977 | B2 | 8/2015 | Fritz et al. | |
| 2003/0052797 | A1 * | 3/2003 | Rock | G01C 21/3697 340/936 |
| 2004/0057795 | A1 | 3/2004 | Mayfield et al. | |
| 2004/0193348 | A1 | 9/2004 | Gray et al. | |
| 2007/0164877 | A1 * | 7/2007 | Mumaw | G01C 23/00 340/973 |
| 2007/0178877 | A1 * | 8/2007 | Pemble | H04H 60/80 455/345 |
| 2008/0208417 | A1 | 8/2008 | Buehlmann et al. | |
| 2008/0215192 | A1 * | 9/2008 | Hardman | G01C 23/00 701/3 |
| 2008/0253834 | A1 | 10/2008 | Colvard | |
| 2009/0016818 | A1 | 1/2009 | Hall et al. | |
| 2009/0278740 | A1 * | 11/2009 | Petillon | G01C 21/165 342/357.31 |
| 2010/0023229 | A1 | 1/2010 | Chiocco | |
| 2011/0150572 | A1 | 6/2011 | Fritz et al. | |
| 2011/0200092 | A1 * | 8/2011 | Todoroki | H04N 21/4884 375/240.01 |
| 2011/0206456 | A1 | 8/2011 | Jurasz et al. | |
| 2011/0229264 | A1 | 9/2011 | Weiser | |
| 2012/0001621 | A1 | 1/2012 | Hall et al. | |
| 2012/0001638 | A1 | 1/2012 | Hall et al. | |
| 2012/0101725 | A1 | 4/2012 | Kondekar | |
| 2012/0301220 | A1 | 11/2012 | Snoeck et al. | |
| 2014/0081532 | A1 | 3/2014 | Fritz et al. | |
| 2015/0176990 | A1 | 6/2015 | Fritz et al. | |
| 2016/0123757 | A1 * | 5/2016 | Backstrom | G06T 11/60 701/523 |

FOREIGN PATENT DOCUMENTS

| | | | |
|---|---|---|---|
| DE | 69131837 | T2 | 6/2000 |
| DE | 102010014695 | A1 | 10/2011 |
| DE | 102010048185 | A1 | 4/2012 |
| EP | 1103659 | A2 | 5/2001 |
| EP | 1118713 | A1 | 7/2001 |
| EP | 2336424 | A2 | 6/2011 |
| EP | 2719829 | A1 | 4/2014 |
| WO | 9203701 | A1 | 3/1992 |

* cited by examiner

SELF-PROPELLED CONSTRUCTION MACHINE AND METHOD FOR VISUALIZING THE WORKING ENVIRONMENT OF A CONSTRUCTION MACHINE MOVING ON A TERRAIN

BACKGROUND OF THE INVENTION

1. Field of the Invention

The invention relates to a self-propelled construction machine, in particular a road milling machine or a slipform paver, comprising a chassis which comprises front and rear wheels or running gears in the working direction, a machine frame supported by the chassis, a drive device for driving the front and/or rear wheels or running gears, and a steering gear for steering the front and/or rear wheels or running gears such that the construction machine can carry out translational and/or rotational movements on the terrain. In addition, the invention relates to a method for visualising the working environment of a construction machine moving on the terrain, in particular a road milling machine or a slipform paver.

2. Description of the Prior Art

Various types of self-propelled construction machines are known. These machines include in particular the known slipform pavers or road milling machines. These construction machines are distinctive in that they comprise a working device for installing structures on the terrain or for modifying the terrain.

The slipform pavers comprise a device for moulding flowable material, in particular concrete, which device is also known as a concrete trough. Structures of various designs, for example guide walls or gutters, can be produced using the concrete trough. In the case of road millers, the working device comprises a milling roller equipped with milling tools, by means of which material can be milled off the road surface in a predefined working width.

EP 2 336 424 A2 describes a self-propelled construction machine comprising a unit for determining data describing a target curve in a reference system independent of the position and orientation of the construction machine, and a control unit which is configured such that a reference point on the construction machine moves along the target curve from a predefined starting point at which the construction machine has a predefined position and orientation on the terrain.

EP 2 719 829 A1 discloses a method for controlling a construction machine, in which the data describing a target curve are determined in a reference system independent of the position and orientation of the construction machine by means of a measuring device (rover) on the terrain and are input into a working memory of the construction machine. The known method makes it possible to more accurately control the construction machine without great complexity in terms of measurement.

When planning a construction project to be carried out using the known slipform pavers or road millers, the problem arises that objects already existing on the terrain, such as water outlets, hydrants or manhole covers, must be taken into account. For example, the structure should not be located on a water outlet, or the region of the terrain in which, for example, a hydrant or manhole cover is to be found, should not be modified.

In order to take into account objects present on the terrain, intervention in the machine control is necessary, which may be carried out manually.

The milling roller of a road milling machine must, for example when travelling over a hydrant, be raised from a predefined position relative to the surface to be worked, taking account of a safety distance within a path distance dependent on the dimensions of the hydrant. In practice, however, the machine operator cannot identify the exact position of the hydrant at the level of the milling roller, since the milling roller is located below the cab. Therefore, in practice, the position of a hydrant on the terrain is marked by visible lines, which can be identified by the machine operator or another person. In practice, however, marking objects present on the terrain is disadvantageous. Firstly, marking the objects requires an additional work step. In addition, it is difficult to mark the lines exactly at right angles to the direction of travel. Moreover, the lines are impossible or difficult to identify in the dark. Furthermore, marking the objects is difficult when it is raining. Due to the inaccuracies, it is therefore necessary to select a relatively large safety distance which requires significant reworking.

In the case of a slipform paver, the same problem arises when a structure is to be installed which is to be located not on, but rather beside, objects present on the terrain. If, for example, the structure is to extend along a curb, water outlets beside the curb cannot be identified by the machine operator if the water outlets are located immediately in front of or beside the machine. In the case of a slipform paver, an additional difficulty is that it is not possible to correct the path course at short notice if it is identified only shortly before the water inlet that the planned path course extends over said inlet.

In order to automatically control the construction machine while also taking account of objects present on the terrain, it is possible in principle to determine the shape and the location of the objects on the terrain. If the shape and location of the objects are known, intervention in the machine control can also occur automatically; for example, the milling roller of a road milling machine can be automatically raised when travelling over the object. However, this requires an exact determination of the shape and location of the object, for example the hydrant, in relation to the coordinate system in which the construction machine is to move. Otherwise, the hydrant or the construction machine may be damaged.

SUMMARY OF THE INVENTION

The problem addressed by the invention is that of providing a self-propelled construction machine, in particular a road milling machine or a slipform paver, which makes it easier in practice to take account of objects present on the terrain when controlling the construction machine in order to install a structure or to modify the terrain. A further problem addressed by the invention is that of providing a method by means of which objects present on the terrain can be more easily taken into account.

According to the invention, these problems are solved by the features of the independent claims. The subjects of the dependent claims relate to preferred embodiments of the invention.

The construction machine according to the invention is a self-propelled construction machine, comprising a working device for installing structures on the terrain, for example a device for moulding concrete or a device for modifying the terrain, for example a milling roller. The specific way in which the working device is configured is unimportant for the invention. The construction machine may, for example, be a road milling machine or a slipform paver. However, it may also be a road finisher, in which case the same problem arises of taking account of objects already present on the terrain.

The construction machine comprises an image recording or image capturing unit for recording an image segment of the terrain which is in a coordinate system dependent on the position and orientation of the construction machine on the terrain, and a display unit for displaying the image segment of the terrain. The image segment should be selected so that all the regions relevant to the control of the construction machine are detected, it being possible for the image segment to also include regions which the machine operator cannot see from the cab. The image recording unit may comprise one or more camera systems. If the image recording unit comprises a plurality of camera systems, the image segment may be composed of a plurality of images, each of which are captured by one camera system. However, it is also possible for an individual image segment to be assigned to each camera system.

The camera system may comprise one camera or two cameras (stereo camera system). When, in the case of capture using one camera, a three-dimensional scene is formed on the two-dimensional image plane of the camera, a clear correlation results between the coordinates of an object, the coordinates of the depiction of the object on the image plane, and the focal length of the camera. However, the depth information is lost by the two-dimensional capture.

It is sufficient for the invention if the camera system comprises just one camera, since in practice the curvature of the terrain surface in the image segment captured by the camera can be ignored. Moreover, just two-dimensional scenes, i.e. the contours of the objects in one plane (the terrain surface), are relevant for the invention. However, the invention is not limited thereto.

In order to detect three-dimensional scenes and/or to take into account a curvature of the terrain surface, the at least one camera system of the image recording unit may also be a stereo camera system comprising two cameras which are arranged so as to be axially parallel having a predefined horizontal spacing, in order to be able to obtain the depth information from the disparity in accordance with the known method.

The invention presupposes a device for providing project data describing the shape and location of at least one project in a coordinate system independent of the position and orientation of the construction machine. A project means all the work to be carried out using the construction machine, which work forms a basis for the control of the construction machine, the project being determined by the type of work (shape) being carried out at a specific place (location). The project may involve installing a structure or modifying the terrain. Thus, the project data may be the data which describe the shape and location of a structure to be installed on the terrain. In the case of the known slipform pavers, the project data may, for example, be the data describing the shape and location of a guide wall to be installed or, in the case of the known road milling machines, the data describing a surface on the terrain to be worked or not to be worked. The project data constitute parameters for controlling the construction machine which also comprise, for example, the feed rate and inclination of the concrete trough of a slipform paver or the cutting depth of a milling machine. All that is crucial for the invention is for project data of one or more arbitrary projects to be available.

In addition, the construction machine comprises a data processing unit which is configured in such a way that the part of the project located in the image segment is superimposed on the image segment of the terrain displayed on the display unit, such that at least part of the project is displayed in the image segment. The display unit thus displays not only the real image segment, but also a virtual image of the project, so as to widen the perception of the machine operator. As a result, the machine operator can identify on the display unit whether the project on which the control is based fits with the reality.

If an error occurs when generating the project data, the machine operator can already intervene in the machine control in advance. Alternatively, automatic intervention in the machine control may be carried out. This error may, for example, be that the object or objects present on the terrain, which reflect the reality, have not been detected or have been incorrectly detected for controlling the construction machine. For example, the machine operator can identify if the surface to be worked, for example the surface to be milled off using a road milling machine, is located on a hydrant, or if the structure to be installed using a slipform paver, for example a guide wall, is to extend over a water inlet.

A preferred embodiment of the invention provides for the construction machine to comprise a device for determining position/orientation data describing the position and orientation of the construction machine in a coordinate system independent of the construction machine. The project data are determined in a coordinate system independent of the position and orientation of the construction machine and does not change as the construction machine moves on the terrain.

The device for determining the position/orientation data describing the position and orientation of the construction machine preferably comprises a global navigation satellite system (GNSS) which may comprise a first and a second GNSS receiver for decoding GNSS signals from the global navigation satellite system (GNSS) and correction signals from a reference station for determining the position and orientation of the construction machine, the first and second GNSS receivers being arranged in different positions on the construction machine. The measuring accuracy can be increased by means of the first and second GNSS receivers. Instead of using a global navigation satellite system (GNSS), the position and orientation of the construction machine can also be determined using a system independent of satellites, for example a tachymeter.

A further preferred embodiment provides for the project data describing the shape and location of the at least one project in the coordinate system independent of the position and orientation of the construction machine to be transformed, on the basis of the known position and orientation of the construction machine in the coordinate system independent of the position and orientation of the construction machine, into the coordinate system dependent on the position and orientation of the construction machine. The project data available in the fixed coordinate system can then be superimposed in real time on the image segment, with the result that the project is always visible in a manner correctly aligned with the real image which may change continuously as the construction machine moves.

The image processing unit can obtain various image data from the project data, by means of which the project can be visualised on the display unit for the machine operator. A simplified depiction of the project is generally sufficient for the visualisation. The project data preferably comprise data describing at least one contour of the project, the data processing unit being configured in such a way that the at least one contour of the project is displayed in the image segment of the terrain. The location and the shape of the project are sufficiently marked in the image segment by the contour. If the project is a structure for example, the structure may also be further accentuated by a coloured underlay or a hatching or be depicted purely thereby.

In a further particularly preferred embodiment, the data processing unit is configured in such a way that object data are determined which describe the shape and location of at least one real object in the image segment of the terrain, the project data then being compared with the object data. In this context, object data are understood to be all the data by means of which the shape and location of the objects present on the terrain and recorded by the image recording unit are described, which data are depicted as actual objects in the image segment. The object data may for example describe the location and shape of a structure, for example a hydrant or a water inlet, on the terrain, which must not be covered or damaged when installing a structure or modifying the terrain. In addition to widening the perception of the machine operator, comparing the project data with the object data also permits computer-aided monitoring of the control of the construction machine, it being possible to identify if the determined project data do not correspond to the object data (reality). The known mathematical algorithms can be used for the comparison, for example to determine whether the structure is actually located beside the water inlet.

A particularly simple evaluation of the data provides for the spacing between at least one reference point relating to the contour of the project and at least one reference point relating to the contour of the object to be determined. In this case, the reference point itself may be located on the contour, for example on a circle or arc, or beside the contour, for example at the center of a circle. The determined spacing is preferably compared with a predefined threshold value. If the spacing between the reference points located on the contours is smaller than a predefined threshold value, it can be concluded that a minimum spacing is not adhered to. This minimum spacing can be visualised on the display unit. A further option is to base the evaluation on the surfaces enclosed by the contours. It is also possible to determine whether the contours of the project determined while taking account of a predefined minimum spacing around the object intersect with the contours of the object. In the event that the project line and the object line intersect, it can be concluded that the project line does not surround the object line, i.e. the project and object do not match, but overlap one another at least in part.

The construction machine preferably comprises an alarm unit which emits an optical and/or acoustic and/or tactile alarm if the data processing unit has identified that the project and object do not match, for example that the project line and object line intersect and/or that the determined spacing between the contours of the project and object is smaller than a predefined threshold value. A control signal for an intervention in the machine control can also be generated.

The manner in which project data are provided is unimportant for the invention. In a preferred embodiment, the construction machine comprises an interface for inputting the project data and a storage unit for storing the input project data. It is thus possible to determine in advance the project data required for controlling the construction machine. The project data are preferably determined on the terrain, using a measuring device (rover) which is preferably satellite-aided.

BRIEF DESCRIPTION OF THE DRAWINGS

In the following, different embodiments of the invention are described in more detail with reference to the drawings, in which.

DETAILED DESCRIPTION

Figure 1A:
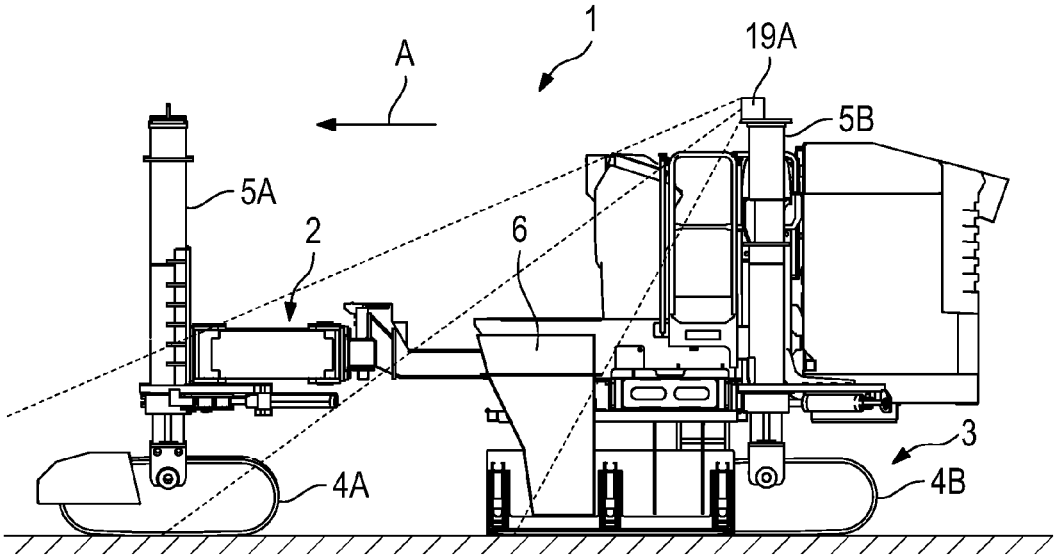
FIG. 1A is a side view of an embodiment of a slipform paver.
Figure 1B:
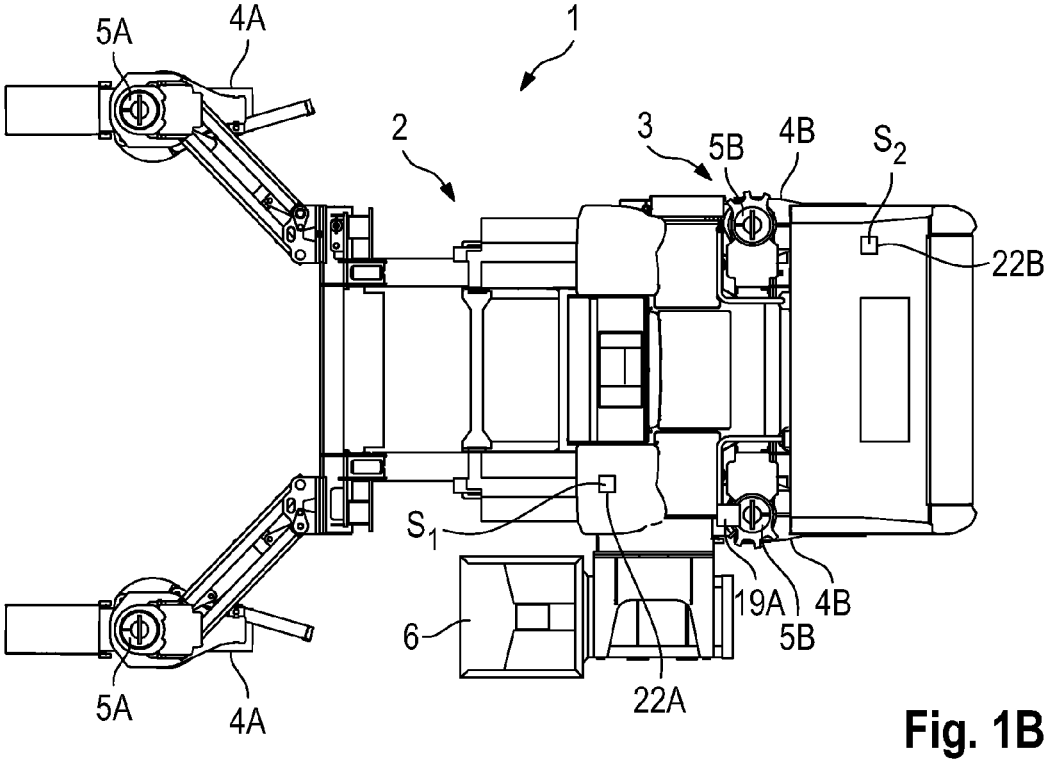
FIG. 1B is a plan view of the slipform paver of FIG. 1A.

FIGS. 1A and 1B are the side view and plan view of a slipform paver as an example of a self-propelled construction machine. A slipform paver of this kind is described in detail in EP 1 103 659 B1. Since slipform pavers per se belong to the prior art, only the components of the construction machine related to the invention are described here.

The slipform paver 1 comprises a machine frame 2 which is carried by a chassis 3. The chassis 3 comprises two front and two rear chain running gears 4A, 4B which are fastened to front and rear lifting columns 5A, 5B. The working direction (direction of travel) of the slipform paver is indicated by an arrow A. However, it is also possible for just one front or rear running gear to be provided.

The chain running gears 4A, 4B and the lifting columns 5A, 5B form the drive device of the slipform paver for carrying out translational and/or rotational movements of the construction machine on the terrain. By raising and lowering the lifting columns 5A, 5B, the height and inclination of the machine frame 2 can be moved relative to the ground. The slipform paver can be moved forwards and backwards by means of the chain running gears 4A, 4B. The construction machine thus has three translational and three rotational degrees of freedom.

The slipform paver 1 comprises a device 6 for moulding concrete (shown merely as an indication), referred to hereinafter as a concrete trough. The concrete trough 6 constitutes the working device of the slipform paver for installing a structure of a predefined shape on the terrain.

Figure 2A:
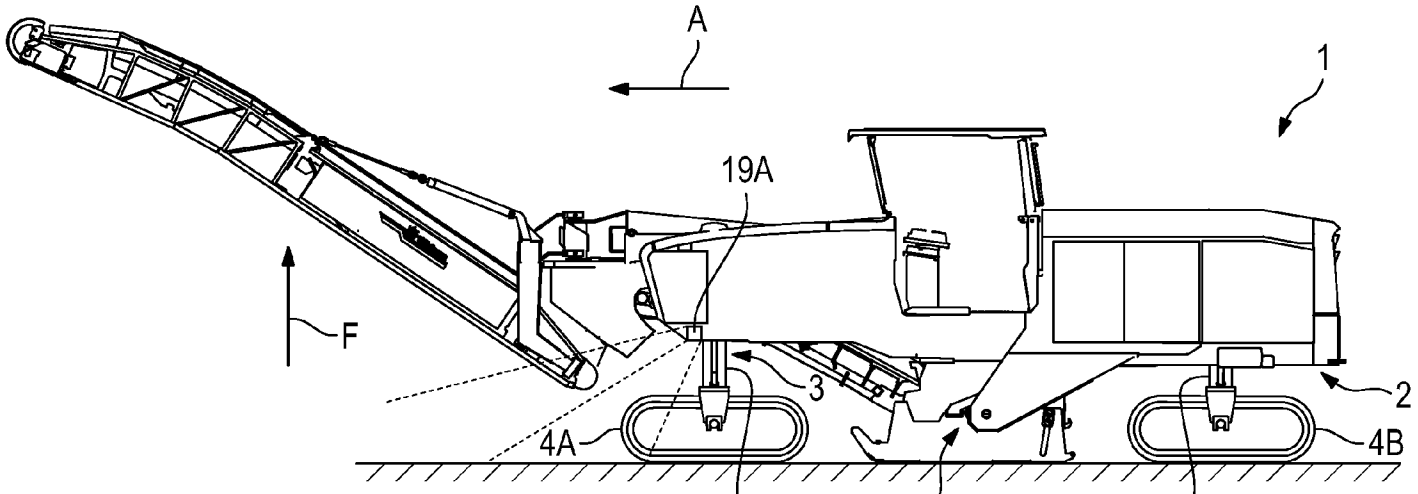
FIG. 2A is a side view of an embodiment of a road milling machine.
Figure 2B:
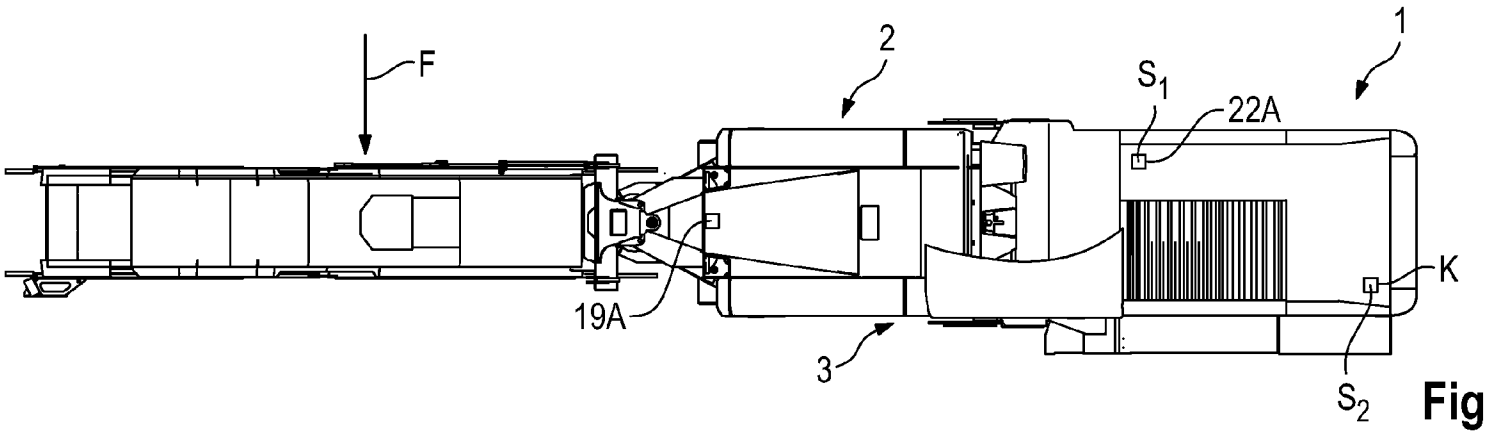
FIG. 2B is a plan view of the road milling machine of FIG. 2A.

FIGS. 2A and 2B show the side view of a road milling machine as a further example of a self-propelled construction machine, the same reference signs being used for the corresponding parts. The road milling machine 1 also comprises a machine frame 2 which is carried by a chassis 3. The chassis 3 again comprises front and rear chain running gears 4A, 4B which are fastened to front and rear lifting columns 5A, 5B. However, it is also possible for just one front or rear running gear to be provided. The road milling machine comprises a working device for modifying the terrain. In this case, this is a milling device 6 comprising a milling roller equipped with milling tools which, however, cannot be identified in the figures. The milling material is removed by means of a conveyor F.

Figure 3:
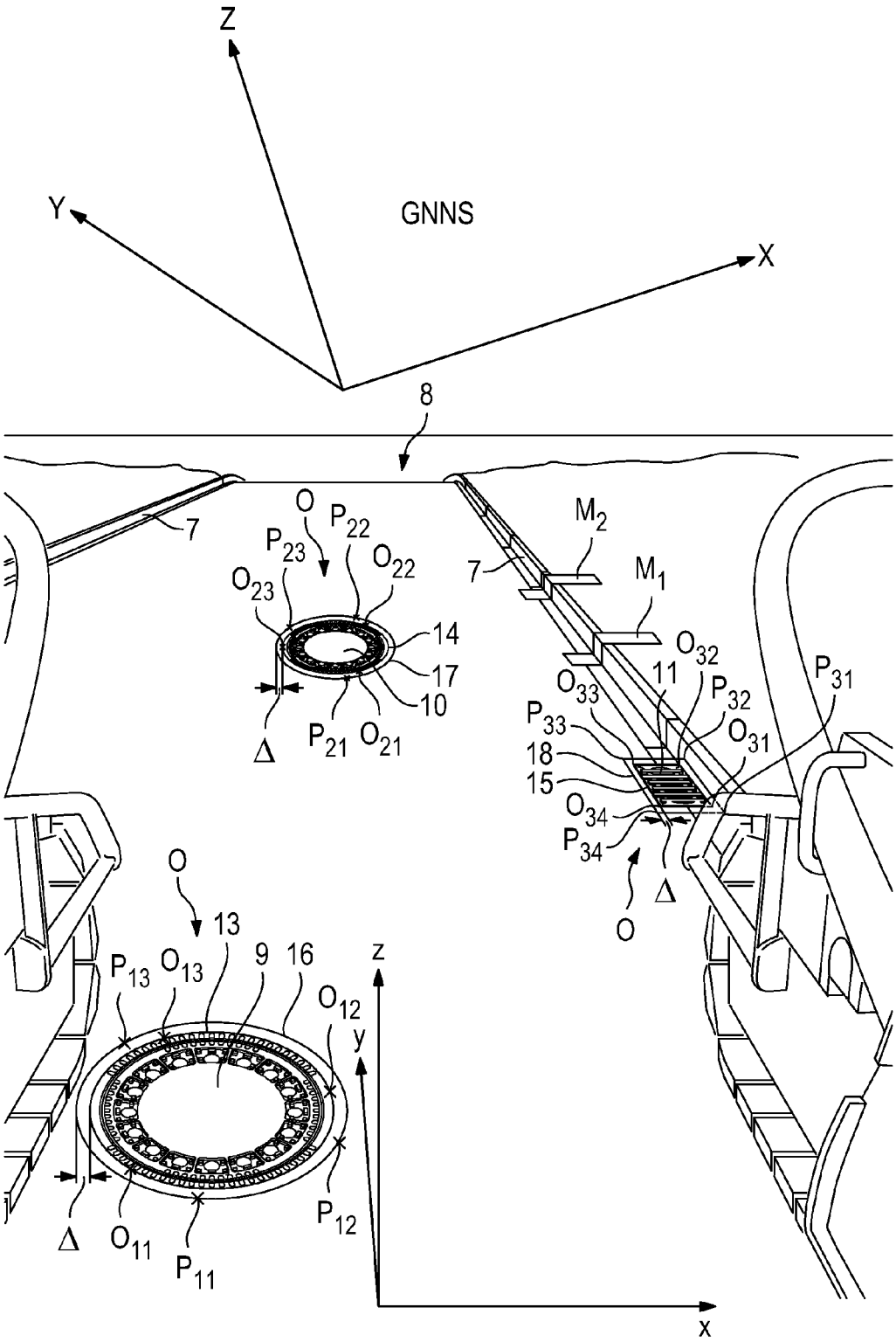
FIG. 3 shows the road surface to be worked using a road milling machine, together with the coordinate system independent of the movement of the construction machine, and the coordinate system dependent on the movement of the construction machine.

The road surface to be worked using a road milling machine is shown in FIG. 3. A road 8 delimited by curbs 7 extends over the terrain. In this embodiment, the project consists in milling off the surface of the road. In this case, it should be taken into account that certain objects O, for example manhole covers, are located in the center of the road surface, and water inlets are located at the side of the road surface. FIG. 3 shows two manhole covers 9, 10 and a water inlet 11, over which the road milling machine travels when milling off the road surface. However, the illustration in FIG. 3 does not correspond to the field of vision of the machine operator. The machine operator cannot see the objects O on the road from the cab of the construction machine, since said objects are located immediately in front of the construction machine or below the machine. In particular, the machine operator cannot identify the manhole cover when the milling roller is located just a short distance in front of the manhole cover, i.e. precisely at the time at which the machine operator must raise the milling roller. However, this region cannot be monitored by a camera either, on account of the milling material flying around in the housing of the milling roller.

Since the machine operator cannot identify the manhole covers, in practice lateral markings are made at the level of the manhole covers, which markings are indicated as $M_1$ and $M_2$ in FIG. 3. These markings are intended to allow the machine operator or another person to identify the position of the manhole covers so that the milling roller can be raised at the correct time. However, such markings are not required in the case of the construction machine according to the invention.

The location and shape of the circular manhole covers 9, 10 are clearly delineated by three reference points $O_{11}$, $O_{12}$, $O_{13}$ and $O_{21}$, $O_{22}$, $O_{23}$ located on the circumference of the circle. The location and shape of the rectangular water inlets are delineated by four reference points $O_{31}$, $O_{32}$, $O_{33}$, $O_{34}$ which are located at the corners of the water inlet.

Figure 8:
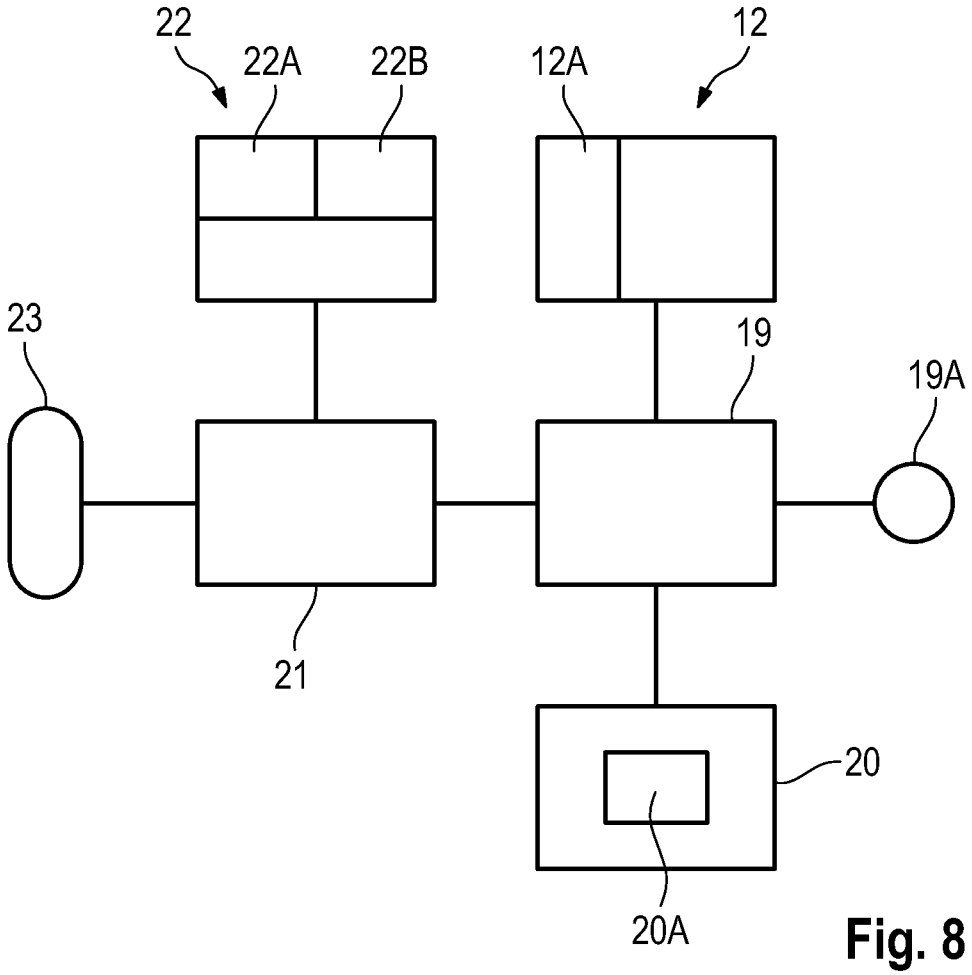
FIG. 8 is a block diagram showing the components for visualising the working environment of the construction machine according to the invention.

The project is described by the previously generated project data, which are input into a working memory 12 of the construction machine via an appropriate interface 12A (FIG. 8). The project data contain the coordinates of the reference points characteristic for the project, which are detected in a coordinate system (X, Y, Z) independent of the position and orientation of the construction machine. In this embodiment, the reference points are located on the contours 13, 14, 15 which surround the contours 16, 17, 18 of the objects O at a predefined minimum spacing Δ. Since, in this embodiment, the objects O are circular manhole covers 9, 10 and rectangular water inlets 11, the contours delineating the project are also circles and rectangles. The circular contours 13, 14 of the project are clearly delineated in the coordinate system (X, Y, Z) independent of the movement of the construction machine by the coordinates of three reference points $P_{11}$, $P_{12}$, $P_{13}$ and $P_{21}$, $P_{22}$, $P_{23}$, and the rectangular contours 15 of the project are delineated therein by the coordinates of four reference points $P_{31}$, $P_{32}$, $P_{33}$, $P_{34}$.

The project data comprise the coordinates of the reference points of the project in the fixed coordinate system (X, Y, Z) independent of the movement of the construction machine. Said data mark the surface to be milled off, which lies outside the contours 13, 14, 15 of the project. The surface which is not to be worked is the surface located within the contours 13, 14, 15 of the project, in which the objects O are located. The project is clearly determined in this way.

The project data can be determined in the following manner. The fixed coordinate system (X, Y, Z) is preferably the coordinate system of a global satellite navigation system (GNSS), with the result that the reference points of the object can be detected in a simple manner using a measuring device (rover). The reference points $P_{11}$, $P_{12}$, $P_{13}$ and $P_{21}$, $P_{22}$, $P_{23}$ and $P_{31}$, $P_{32}$, $P_{33}$, $P_{34}$ of the project are determined from the reference points $O_{11}$, $O_{12}$, $O_{13}$ and $O_{21}$, $O_{22}$, $O_{23}$ and $O_{31}$, $O_{32}$, $O_{33}$, $O_{34}$ of the objects, while taking account of a minimum spacing Δ between the contours 13, 14, 15 of the project and the contours 16, 17, 18 of the object. The project data can be stored in an external storage unit, for example a USB stick, and input into the internal storage unit 12 of the construction machine via the interface 12A. The construction machine can then be controlled using said data. When the road milling machine reaches a surface which is not to be worked, the milling roller is automatically raised relative to the ground. As soon as the road miller has traveled over the surface which is not to be worked, the milling roller is lowered again. This prevents the manhole covers 9, 10 or the water inlet 11 and/or the construction machine from being damaged. However, the milling roller may also be raised and lowered by means of manual intervention in the machine control, the point in time at which the intervention is to be made being signalled to the machine operator.

In practice, it could be that the reference points of the project are not correctly detected in the GNSS coordinate system independent of the road milling machine, taking account of the object O. There is then the risk that the manhole covers 9, 10 or water inlet 11 are not located within the previously determined contours 16, 17, 18, resulting in damage to the manhole covers or water inlet and/or the machine.

Figure 4:
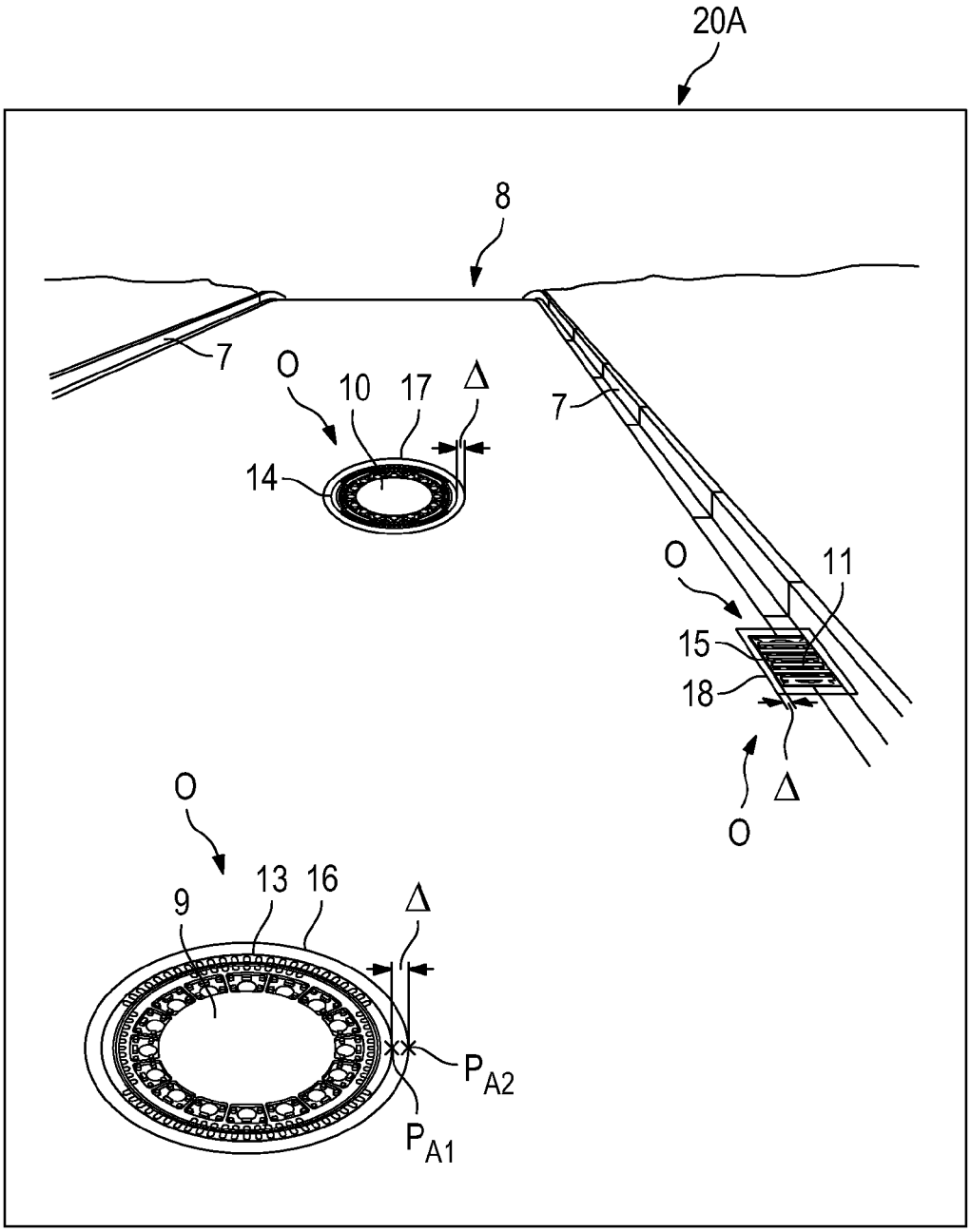
FIG. 4 shows the image segment of the terrain displayed on the display unit of the road milling machine.

The road milling machine comprises an image recording unit 19 comprising a camera system 19A arranged on the machine frame 2, by means of which system an image segment 20A of the terrain to be worked, i.e. of the road surface comprising manhole covers and water inlets, is captured. The camera system 19A detects a region which cannot be seen by the machine operator in the cab. The image segment 20A is displayed on a display unit 20, for example an LC display. FIG. 4 shows the display of the display unit 20. While the road miller moves on the terrain, the image shown in the image segment 20A changes continuously, with the result that the machine operator can identify that he is approaching a manhole cover 9, 10 or water inlet 11 with the road miller.

In addition, the road milling machine comprises a data processing unit 21, by means of which the available project data are processed. The data processing unit 21 is configured in such a way that the project located in the image segment is superimposed on the image segment 20A of the terrain displayed on the display unit 20. In this embodiment, the contours 16, 17, 18 of the project, which mark the surface to be worked and the surface not to be worked, are displayed in the image segment 20A in the manner in which they correspond to the previously determined project data. The machine operator can thus immediately identify on the display unit 20 if the project data do not correspond to the reality, i.e. if the contours 16, 17, 18 of the project do not concentrically surround the contours 13, 14, 15 of the object O at a predefined minimum spacing Δ. However, if the manhole covers and water inlets are located within the displayed contours, the road miller can be controlled without any intervention in the machine control.

A coordinate system (x, y, z) dependent on the movement of the construction machine on the terrain is assigned to the image segment 20A, which coordinate system is shown in FIG. 3. The position (origin) and alignment of said coordinate system corresponds to the location and angle of view of the camera 19A on the construction machine. The location and shape of the objects O are also delineated by corresponding coordinates in this coordinate system.

The coordinate system (x, y, z) dependent on the movement of the construction machine on the terrain may be a three-dimensional or two-dimensional coordinate system. FIG. 3 shows the general case of a coordinate system having an x-axis, y-axis and a z-axis. However, a two-dimensional coordinate system is sufficient in the event of a curvature of the surface of the terrain which is to be ignored, and when observing merely two-dimensional objects. However, this presupposes that the x/y plane of the coordinate system is in parallel with the surface of the terrain, which is assumed to be flat. In the following, it is assumed that this is the case.

The camera system may be a stereo camera system or a camera system comprising just one camera. However, a camera system comprising just one camera is sufficient in the event of a curvature of the surface of the terrain which is to be ignored and/or when taking account only of two-dimensional objects. If the camera system is a stereo camera system, three-dimensional images can also be displayed on the display unit 20 by means of the known method.

In order to determine the position and orientation of the construction machine, and thus also the position and orientation (angle of view) of the camera system 19A in the coordinate system (X, Y, Z) independent of the position and orientation of the construction machine, the construction machine comprises a device 22 which provides the position/orientation data of the construction machine (FIG. 8). This device may comprise a first GNSS receiver 22A and a second GNSS receiver 22B which are arranged in different positions S1, S2 on the construction machine. FIG. 1B shows the position S1 and S2 of the two GNSS receivers 22A and 22B on the slipform paver. The first and second GNSS receivers 22A, 22B decode the GNSS signals from the global navigation satellite system (GNSS) and correction signals from a reference station in order to determine the position and orientation of the construction machine. Systems of this kind, which permit very precise determination of the position/orientation data, belong to the prior art. However, instead of the second GNSS receiver, an electronic compass K may also be provided in order to detect the orientation of the construction machine. FIG. 2B shows the position S1 of the first GNSS receiver 22A and the position S2 of the compass K on the road milling machine. However, the compass may also be dispensed with when calculating the orientation of the construction machine. The orientation can be calculated in that the location of a reference point of the construction machine at successive points in time is determined and the direction of movement is determined from the change in location. The accuracy can be additionally increased by including the steering angle in the calculation.

The data processing unit 21 receives the current position/orientation data which are continuously provided by the device 22 for determining the position and orientation of the construction machine, and transforms the shape and location of the project in the project data describing the coordinate system (X, Y, Z) independent of the position and orientation of the construction machine into the machine coordinate system (x, y, z) dependent on the position and orientation of the construction machine, on the basis of the position and orientation of the construction machine in the coordinate system independent of the construction machine. This data transformation takes place in real time. Once the coordinates of the reference points in the machine coordinate system marking the contours of the project are known, the contours 16, 17, 18 of the project are displayed in the image segment 20A (FIG. 4). The data processing unit operations required for generating the contours belong to the prior art.

If no project data are present for the depicted image segment 20A, no visualisation occurs on the display unit 20. Otherwise, the machine operator is shown the relevant information as virtual objects beside the image of the actual objects (hydrant 9, 10 or water inlet 11) by means of the contours 16, 17, 18, which contours should match the actual objects O detected in the camera image. As a result, the machine operator can constantly monitor the control of the construction machine.

The data processing unit 21 may comprise an image processing unit which can automatically identify whether the actual objects O match the virtual objects, i.e. whether the actual contours 13, 14, 15 of an object O (hydrant or water inlet) shown in the image segment are actually located within the associated virtual contours 16, 17, 18 of the project. The data processing unit 21 is configured such that the shape and location, in the image segment 20A, of the actual object O (hydrant or water inlet) captured by the camera system 19A is determined. The data processing unit 21 can make use of the known methods of image recognition for this purpose. The shape and location of the actual object in the image segment are described by object data. For example, the circular contour of the manhole cover 9 is delineated by the three reference points $P_{11}$, $P_{12}$, $P_{13}$ located on the contour (FIG. 3).

In the data processing unit 21, the object data are compared with the project data in order to identify whether the actual objects match the virtual objects. In this embodiment, the data processing unit checks whether the contour 13 of the actual object, for example the manhole cover 9, is located within the contour 16 of the project. For this purpose, the data processing unit 21 checks whether the two contours 13, 16 intersect. If the contours 13, 16 do not intersect, it is concluded that the object data correspond to the reality. Otherwise, it is concluded that the project data have been incorrectly determined.

Figure 5A:
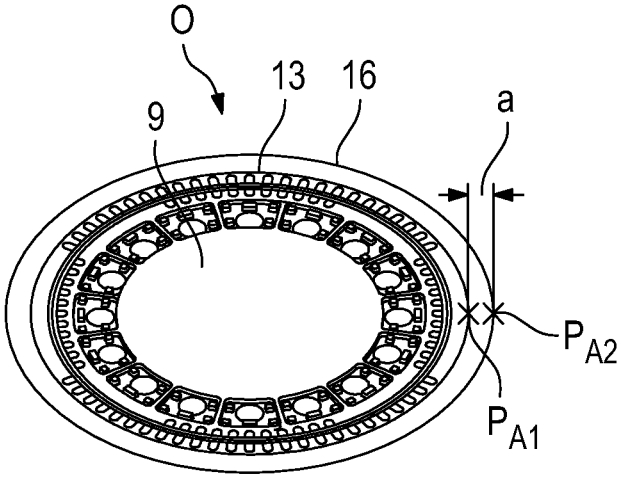
FIG. 5A is an example of the superimposition of the contours of a project and an object in the image segment, in which the contours of the project and object do not intersect.
Figure 5B:
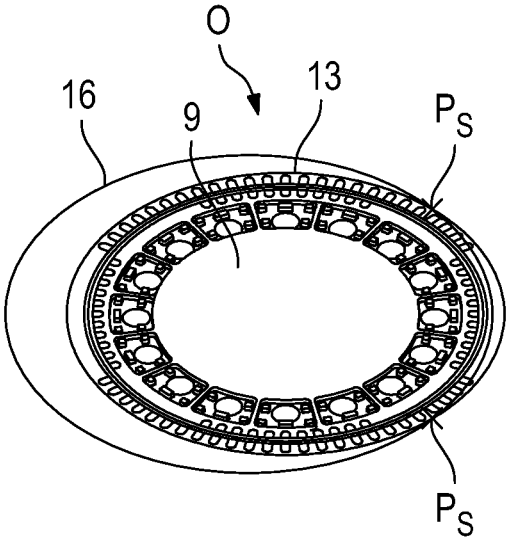
FIG. 5B is an example of the superimposition of the contours of a project and an object in the image segment, in which the contours of the project and object intersect.

FIG. 5A shows the case in which the object data match the project data, i.e. the contours 13, 16 do not have any intersection point, while FIG. 5B shows the case in which the object data do not match the project data, i.e. the contours 13, 16 intersect at two points R.

Furthermore, in a preferred embodiment the data processing unit 21 can also identify whether a minimum spacing Δ is adhered to. For this purpose, the data processing unit determines two reference points $P_{A1}$ and $P_{A2}$ which are assigned to the contour 13 of the object and the contour 16 of the project respectively. For example, points which are located particularly close to one another on the circular contours 13, 16 may be determined as reference points $P_{A1}$, $P_{A2}$ (FIG. 5A). The data processing unit 21 determines the spacing a between the reference points $P_{A1}$, $P_{A2}$ located on the contours and compares the spacing a with a predefined threshold value. If the spacing between the points is smaller than the predefined threshold value, it is concluded that the contour 13 of the object is located within the project, since the contours 13, 16 do not intersect. However, it is concluded that a minimum spacing Δ is not adhered to, with the result that there is still a risk of damage to the manhole cover or the construction machine. However, the reference points may also be the centers or centroids of the circular contours. In the case of an exact alignment taking account of the predefined minimum spacing Δ, the contours 13, 16 have a common center or centroid, i.e. the spacing between the centers should be as small as possible.

The above embodiment is to be understood merely as an example of an embodiment in order to compare the project data and the object data. However, the data may also be evaluated using all other known algorithms in order to conclude whether the actual objects match the virtual objects.

The construction machine comprises an alarm unit 23 which emits an optical and/or acoustic and/or tactile alarm if the data processing unit 21 has identified that the two contours 13, 16 do not match and/or that the spacing a is smaller than a predefined threshold value (FIG. 8). The machine operator can also be made aware of an incorrect determination of the object data by means of coloured underlays on specific surfaces, by hatchings or by markings. The spacing "a" can also be displayed on the display unit 20.

In the following, a further embodiment of the invention will be described with reference to FIGS. 6 and 7, which embodiment differs from the previous embodiment in that the project is not the modification of the terrain by means of a road milling machine (FIG. 2) but rather the installation of a structure by means of a slipform paver (FIG. 1). Like the road milling machine, the slipform paver comprises an image recording unit 12 and a data processing unit 21, as well as a device 12 for providing the project data (FIG. 8). The corresponding parts are provided with the same reference signs.

In the present embodiment, the project of the slipform paver is a traffic island which is laterally delimited by a concrete curb 25. The curb 25 comprises, for example, a straight portion 25A which is adjoined by a semi-circular portion 25B. The curb 25 is to be located beside a rectangular water inlet 26, which requires exact control of the slipform paver.

The project data again comprise the coordinates of reference points characteristic for the project, which are detected in a coordinate system (X, Y, Z) independent of the position and orientation of the construction machine. The project data describe the shape and location of the curb 25. The shape and location of the straight portion 25A may for example each be delineated by two reference points, $P_1$, $P_2$ and $P_3$, $P_4$ respectively, which are located at the beginning and end of the inner and outer contours 27, 28 respectively of the curb 25. The semicircular portion 25B may for example be delineated by three reference points $P_2$, $P_5$, $P_6$ and $P_4$, $P_7$, $P_8$, which are located on the inner and outer contours 27, 28 respectively.

The previously determined project data relating to the GNSS system independent of the position and orientation are input into the working memory 12 of the slipform paver via the interface 12A. The control unit of the slipform paver is configured such that the slipform paver moves along a path which corresponds to the course of the curb 25 to be installed.

Figure 6:
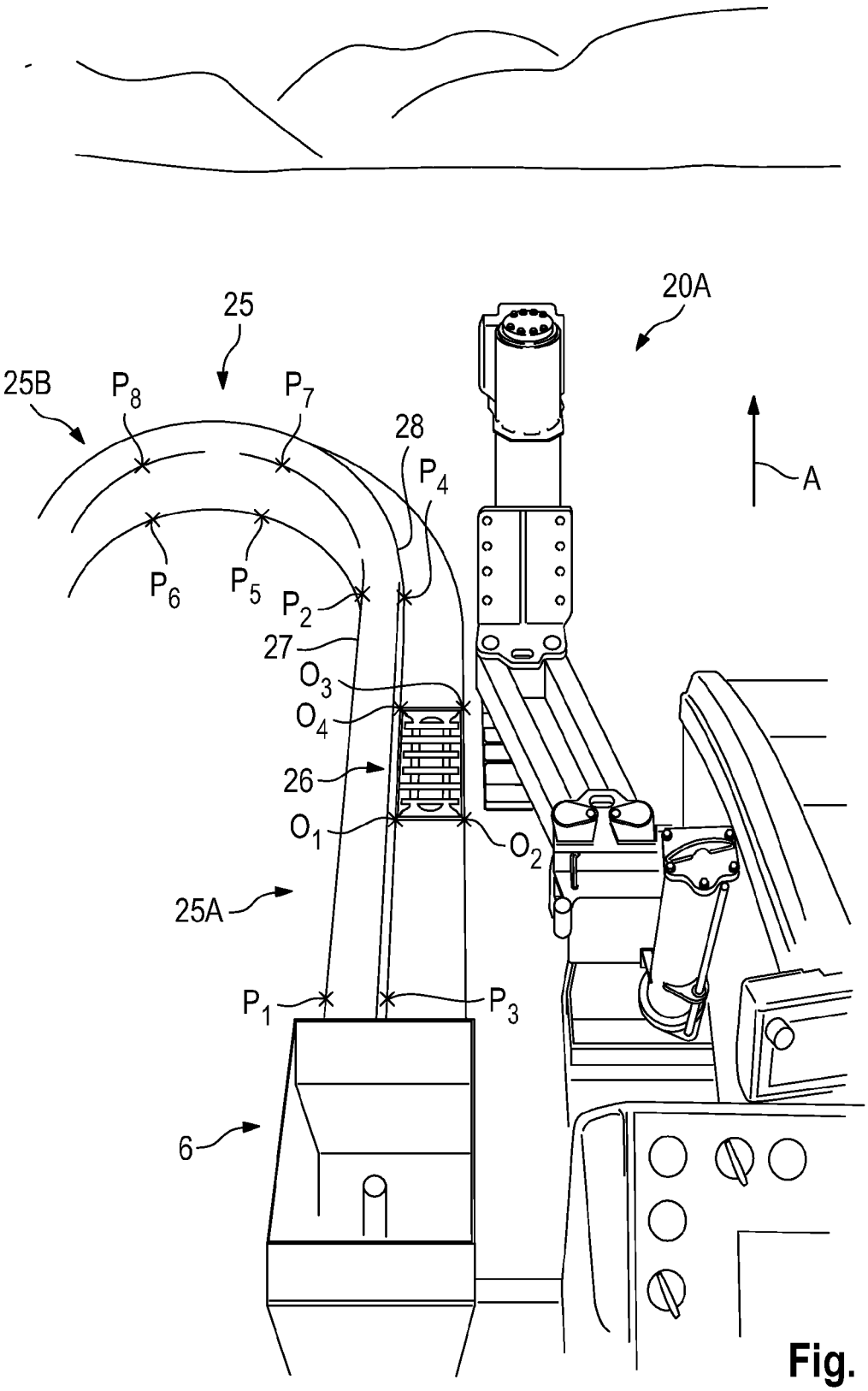
FIG. 6 shows the image segment of the terrain displayed on the display unit of a slipform paver, in which the project and object exactly match.
Figure 7:
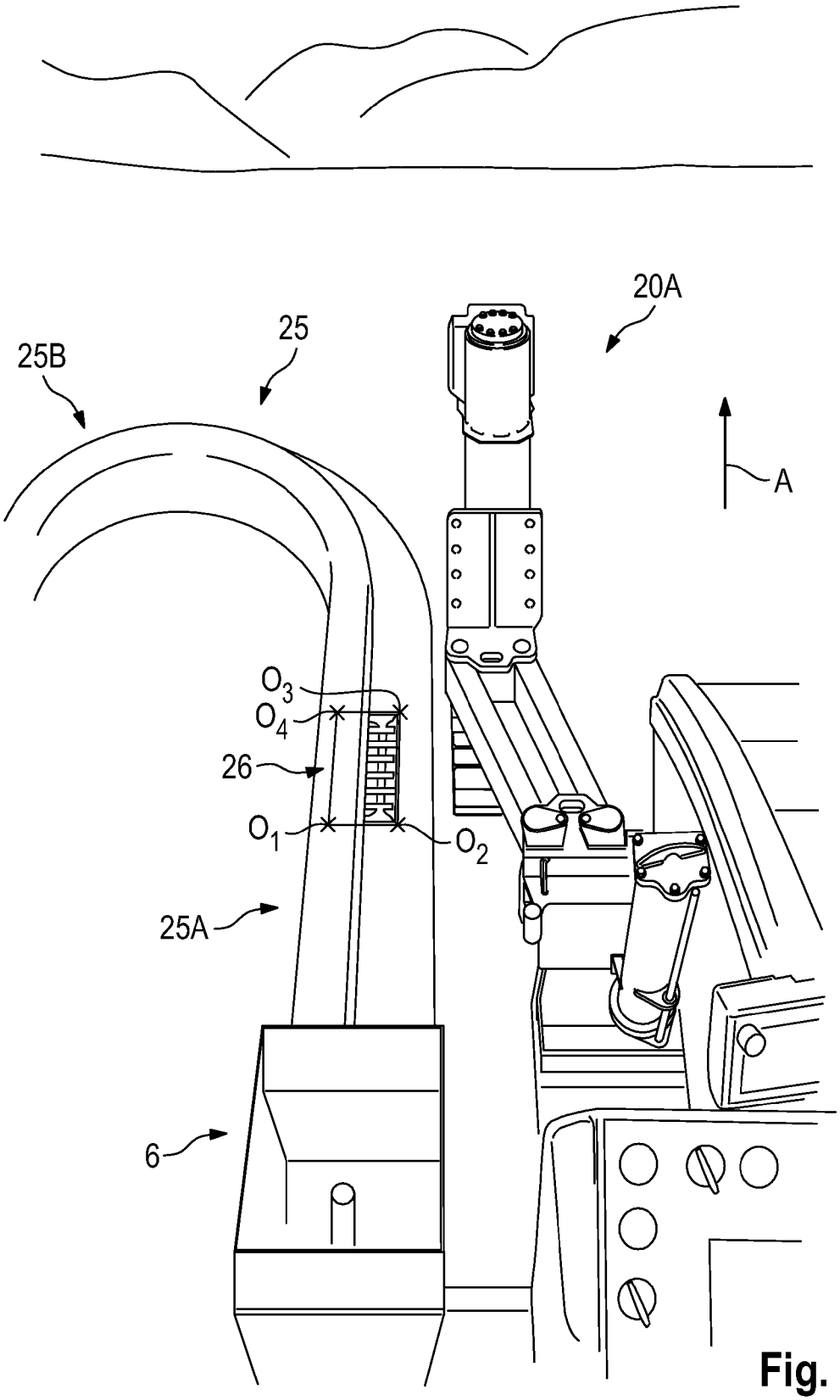
FIG. 7 shows the image segment of the terrain displayed on the display unit of a slipform paver, in which the project and object do not match.

FIGS. 6 and 7 show the image segment 20A captured by the camera system 19A of the image recording unit 19 and displayed on the display unit 20, in which image segment the terrain located in front of the slipform paver in the working direction A and a part of the slipform paver comprising the concrete trough 6 can be identified.

The device 22 for determining the position and orientation of the slipform paver on the terrain continuously calculates the current position/orientation data, the data processing unit 21 transforming the project data present in the GNSS system (X, Y, Z) independent of the position and orientation of the slipform paver into the machine coordinate system (x, y, z) dependent on the position and orientation of the slipform paver, which machine coordinate system corresponds to the angle of view of the camera system. Once the coordinates of the reference points in the machine coordinate system have been determined, the inner and outer contours 27, 28 of the straight and semicircular portion 25A, 25B are superimposed on the camera image.

FIGS. 6 and 7 show an option for depicting the curb 25 in the image segment 20A by means of the contours 27, 28 which show the machine operator the course of the curb to be produced by the slipform paver, when the stored project data form the basis of the control. In addition to the inner and outer contours 27, 28, coloured underlays, hatchings, subsidiary lines or markings can also be generated by the data processing unit 21 and displayed on the display unit 20 for the purpose of visualising the curb 25 in the camera image. The machine operator can check the correct course of the curb 25 in the image segment 20A. The operator can identify in advance whether the curb 25 extends beside the water inlet 26 for example.

FIG. 6 shows the case of a correct course of the curb 25 immediately beside, i.e. at a predefined minimum spacing from, the water inlet 26, while FIG. 7 shows the case in which the curb 25 extends over the water inlet 26. In the second case, the alarm unit 23 generates an alarm signal so that the machine operator can intervene in the machine control.

In a preferred embodiment, the data processing unit 21 determines, by means of image recognition, the coordinates of reference points $O_1$, $O_2$, $O_3$, $O_4$ of the rectangular water inlet 26 in the machine coordinate system (x, y, z) corresponding to the camera image. Since the standard shape and size of the water inlet 26 is known, the coordinates of the corners of the water inlet for example can be determined by means of image recognition without significant mathematical complexity. Said coordinates then provide the object data which are compared with the project data in order to be able to identify whether the plan corresponds to the reality. For this purpose, the data processing unit 21 can check, for example, whether the contours of the curb and water inlet intersect, and/or the data processing unit can calculate, for example, the spacing between the contours, as is described with reference to the other embodiment.

The invention claimed is:

1. A self-propelled construction machine comprising:

a chassis supporting a machine frame and comprising front and rear wheels or running gears for moving the machine in a working direction;

a working tool for working a terrain;

an image recorder fixed relative to the machine frame and configured to record an image segment of a region of the terrain in a first coordinate system dependent on a position and orientation of the construction machine on the terrain;

a display configured to display the image segment of the terrain;

a data storage comprising project data describing a shape and location of at least one project in a second coordinate system independent of the position and orientation of the construction machine, wherein the at least one project comprises one or more structures to be installed or one or more portions of the terrain to be modified, and a data processor configured to superimpose a depiction of at least part of the at least one project located in the region of the terrain associated with the image segment on the displayed image segment of the terrain, wherein at least part of the at least one project is visualised in the image segment.

2. The self-propelled construction machine of claim 1, further comprising one or more sensors configured to provide position and orientation data describing the position and orientation of the construction machine in the second coordinate system.

3. The self-propelled construction machine of claim 2, wherein the one or more sensors comprises a global navigation satellite system (GNSS).

4. The self-propelled construction machine of claim 2, wherein the one or more sensors comprises a first and a second GNSS receiver configured to decode GNSS signals from a global navigation satellite system (GNSS) and correction signals from a reference station, the first and second GNSS receivers being arranged in different positions on the construction machine.

5. The self-propelled construction machine of claim 2, wherein the data processor is configured to transform the project data describing the shape and location of the at least one project in the second coordinate system, based on the position and orientation of the construction machine in the second coordinate system, into the first coordinate system.

6. The self-propelled construction machine of claim 1, wherein the project data further comprises data describing at least one contour of the project, further wherein the data processor is configured to display the at least one contour of the project in the image segment of the terrain.

7. The self-propelled construction machine of claim 1, wherein the data processor is configured to determine object data describing a shape and location of at least one actual object in the image segment of the terrain, and compare the object data with the project data.

8. The self-propelled construction machine of claim 7, wherein the project data further comprises data describing at least one contour of the project, and a spacing is determined between at least one reference point relating to the contour of the project and at least one reference point relating to a contour of the actual object.

9. The self-propelled construction machine of claim 8, further comprising an alarm which produces one or more outputs from a group comprising an optical alarm, an acoustic alarm, a tactile alarm or a control signal for intervention in the machine control, upon the data processor identifying that the spacing is smaller than a predefined threshold value.

10. The self-propelled construction machine of claim 1, further comprising an interface for inputting the project data to the data storage.

11. A method for visualising the working environment of a construction machine moving on and working a terrain, the method comprising:

displaying an image segment of a region of the terrain in a first coordinate system dependent on the position and orientation of the construction machine on the terrain;

providing from data storage project data describing a shape and location of at least one project in a second coordinate system independent of the position and orientation of the construction machine, wherein the at least one project comprises one or more structures to be installed or one or more portions of the terrain to be modified; and superimposing a depiction of at least part of the at least one project located in the region of the terrain associated with the image segment on the displayed image segment, wherein at least part of the at least one project is visualised in the image segment.

12. The method of claim 11, further comprising determining position and orientation data describing the position and orientation of the construction machine in the second coordinate system.

13. The method of claim 12, wherein the position and orientation data describing the position and orientation of the construction machine are determined via a global navigation satellite system (GNSS).

14. The method of claim 12, further comprising transforming the project data into the first coordinate system based on the position and orientation of the construction machine in the second coordinate system.

15. The method of claim 11, wherein the project data describing the shape and location of the at least one project comprise data describing at least one contour of the project, the at least one contour of the project being displayed in the image segment of the terrain.

16. The method of claim 11, further comprising:

determining object data describing a shape and location of at least one actual object in the image segment of the terrain, and comparing the object data with the project data.

17. The method of claim 16, further comprising determining a spacing between at least one reference point relating to at least one contour of the project and at least one reference point relating to at least one contour of the actual object.

18. The method of claim 11, further comprising determining the project data describing the shape and location of the at least one project in the second coordinate system independent of the position and orientation of the construction machine using a rover.

* * * * *